US010179697B2

(12) United States Patent
Chenvainu et al.

(10) Patent No.: US 10,179,697 B2
(45) Date of Patent: Jan. 15, 2019

(54) COMPACT WASTE DISPOSAL DEVICE AND CASSETTE

(71) Applicant: Edgewell Personal Care Brands, LLC, Chesterfield, MO (US)

(72) Inventors: Alexander Chenvainu, Mahwah, NJ (US); Robert F Rosasco, III, Woodbridge, CT (US)

(73) Assignee: Edgewell Personal Care Brands, LLC, Chesterfield, MO (US)

( * ) Notice: Subject to any disclaimer, the term of this patent is extended or adjusted under 35 U.S.C. 154(b) by 0 days.

(21) Appl. No.: 15/417,517

(22) Filed: Jan. 27, 2017

(65) Prior Publication Data

US 2017/0217676 A1 Aug. 3, 2017

Related U.S. Application Data

(60) Provisional application No. 62/288,055, filed on Jan. 28, 2016.

(51) Int. Cl.

| | |
|---|---|
| ***B65F 1/06*** | (2006.01) |
| ***B65F 1/16*** | (2006.01) |
| *B65F 1/12* | (2006.01) |

(52) U.S. Cl.

CPC ..... *B65F 1/062* (2013.01); *B65F 1/163* (2013.01); *B65F 1/12* (2013.01); *B65F 2210/1026* (2013.01); *B65F 2210/167* (2013.01); *B65F 2230/126* (2013.01); *B65F 2230/152* (2013.01); *B65F 2240/132* (2013.01); *B65F 2240/164* (2013.01); *B65F 2250/1143* (2013.01); *B65F 2250/1146* (2013.01)

(58) Field of Classification Search

CPC .. B65F 1/062; B65F 1/06; B65F 1/067; B65F 1/163; B65F 1/1623; B65F 1/16; B65D 88/1606; B65D 43/26

USPC ..... 220/495.08, 495.07, 495.06, 908.1, 908, 220/264, 263, 262, 495.11

See application file for complete search history.

(56) References Cited

U.S. PATENT DOCUMENTS 3,536,192 A * 10/1970 Couper ..... A47K 17/003 206/303
4,519,104 A 5/1985 Nilsson
4,913,308 A * 4/1990 Culbertson ..... B65F 1/06 220/263
5,119,960 A * 6/1992 Robbins, III ..... B29C 47/003 220/640

(Continued)

FOREIGN PATENT DOCUMENTS

CA 2387183 A1 * 6/2003 ..... A47K 11/02
FR 2811650 A1 1/2002

(Continued)

OTHER PUBLICATIONS

Translation of JP H06039804, May 27, 1994, Paragraphs 9-11.*

(Continued)

*Primary Examiner* — Robert J Hicks

(57) ABSTRACT

A waste disposal system with a compact footprint. The waste disposal system device accepts a cassette having a length of tubular liner film. The waste disposal device and cassette can have similar cross-sectional geometry. The waste disposal device and/or cassette comprise a first wall, a second wall, and a first included angle defined therebetween between about sixty and about one-hundred twenty degrees.

43 Claims, 5 Drawing Sheets

(56) References Cited

U.S. PATENT DOCUMENTS

| | | | | |
|---|---|---|---|---|
| 5,651,231 | A | 6/1997 | Garland | |
| 5,662,238 | A * | 9/1997 | Sarno | B65D 25/16 220/495.05 |
| 5,765,339 | A | 6/1998 | Garland | |
| 6,851,251 | B2 | 2/2005 | Stravitz | |
| 7,146,785 | B2 | 12/2006 | Stravitz | |
| 7,316,100 | B2 | 1/2008 | Stravitz et al. | |
| 7,434,377 | B2 | 10/2008 | Stravitz et al. | |
| 7,503,152 | B2 | 3/2009 | Stravitz et al. | |
| 7,503,159 | B2 | 3/2009 | Stravitz et al. | |
| 7,594,376 | B2 | 9/2009 | Chomik | |
| 7,617,659 | B2 | 11/2009 | Stravitz et al. | |
| 7,694,493 | B2 | 4/2010 | Stravitz et al. | |
| 7,696,711 | B2 | 4/2010 | Pollack et al. | |
| 7,708,188 | B2 | 5/2010 | Stravitz et al. | |
| 7,712,285 | B2 | 5/2010 | Stravitz et al. | |
| 7,958,704 | B2 | 6/2011 | Stravitz et al. | |
| 2003/0121923 | A1* | 7/2003 | Morand | A47K 11/02 220/495.07 |
| 2003/0131569 | A1 | 7/2003 | Chomik et al. | |
| 2005/0193692 | A1 | 9/2005 | Stravitz et al. | |
| 2006/0130438 | A1 | 6/2006 | Stravitz et al. | |
| 2009/0152273 | A1* | 6/2009 | Wright | B65D 21/08 220/495.04 |
| 2012/0091295 | A1 | 4/2012 | Morand | |
| 2015/0164293 | A1 | 6/2015 | Shimanuki et al. | |
| 2016/0095763 | A1* | 4/2016 | Mazor | B65F 1/00 206/205 |

FOREIGN PATENT DOCUMENTS

| | | | | |
|---|---|---|---|---|
| FR | 2972431 | A1 * | 9/2012 | B65F 1/02 |
| GB | 2150013 | A * | 6/1985 | B65F 1/06 |
| JP | H0639804 | U | 5/1994 | |

OTHER PUBLICATIONS

Translation of FR2972431, Amar et al., Sep. 14, 2012, p. 5.*
International Search report of PCT/US17/15273, dated Apr. 5, 2017.
International Search Report of PCT/US17/15288, dated Apr. 5, 2017.

* cited by examiner

COMPACT WASTE DISPOSAL DEVICE AND CASSETTE

CROSS-REFERENCE TO RELATED APPLICATIONS

This application claim priority to U.S. Patent Application Ser. No. 62/288,055, filed Jan. 28, 2016, the entirety of which is incorporated herein.

BACKGROUND OF THE INVENTION

1. Technical Field

The present disclosure relates to waste disposal devices and film-dispensing cassettes for use in the same.

2. Background Information

Waste disposal devices that include a cassette are commonly used to store odorous waste, such as diapers and litter. In such waste disposal devices, the cassettes are supported at an opening of a bin and dispense a tubular film projecting into the inner cavity of the bin of the waste disposal devices. The free end of the tubular film can be closed to define a bag-like structure. Often, the waste disposal devices includes an internal mechanism that closes the bag shut (e.g., by clamping, twisting, etc.), thereby isolating the waste in the bag below the internal mechanism, and capturing the odors in the bag.

Waste disposal devices are often located in rooms where space is limited. Consequently, it would be useful to provide a waste disposal device that contain as much or more waste material than most prior art devices, and one that utilizes a compact configuration designed to efficiently utilize floor space.

SUMMARY OF THE APPLICATION

According to an aspect of the present disclosure, a compact waste disposal system is provided. The compact waste disposal system has a waste disposal device and a cassette for receiving waste. The waste disposal device has a first side wall, and a second side wall, where the first side wall and the second side wall are configured to have an included angle β therebetween in the range of about sixty (60) to about one-hundred and twenty (120) degrees. The waste disposal device has a front wall, extending between and connected to the two side wall. The waste disposal device can be said to have a cross-sectional geometry that is generally triangular, a Reuleaux triangle, a conic section (i.e. a slice of a conic), a frusto-conic section, or combinations thereof, in shape.

The cassette can have a similar cross-sectional geometry as the waste disposal device. The cassette has a first side edge, and a second side edge, where the first side edge and the second side edge are configured to have an included angle β therebetween in the range of sixty (60) to about one-hundred and twenty (120) degrees. The cassette has a front edge, extending between and connected to the two side edges. The cassette can be said to have a cross-sectional geometry (in the XY plane) that is generally triangular, a Reuleaux triangle, a conic section, a frusto-conic section, or combinations thereof, in shape. The cassette also provides a length of generally tubular liner film having, during use, an open end for receiving waste and a closed end for storing waste. The cassette defines a central passage through which the liner film passes such that waste can be stored within the film (within the waste disposal device).

The cassette may have one or more walls extending from any edge such that surfaces are defined. In some of these embodiments, the first side edge defines a first side wall extending generally downward, the second side edge defines a second side wall extending generally downward, and the front edge defines a front wall extending generally downward. The first side wall, the second side wall, and the front side wall further define the central passage.

In other embodiments the first side edge, the second side edge and the front edge define an outer edge of the cassette. In some of these embodiments, the first side edge defines a first side wall extending generally downward, the second side edge defines a second side wall extending generally downward, and the front edge defines a front wall extending generally downward, wherein said first side wall, said second side wall, and said front wall further define an outer wall of the cassette.

Optionally, the liner film has an open end that is attached to said cassette. The liner film can have a second end that is open and requires mechanical or other closure (knot, heat, chemical or adhesive seal, tie-off, etc. . . . ) or is manufactured to have a sealed second end.

In further embodiments, the waste disposal device has a first front wall having a first wall portion and a second wall portion defining a second included angle α therebetween in the range of about ninety (90) to about one-hundred and fifty (150) degrees. Similarly, a cassette has a front edge having a first edge portion and a second edge portion such that said first edge portion and said second edge portion have a second included angle therebetween in the range of about ninety (90) to about one-hundred and fifty (150) degrees. In these embodiments, the waste disposal device and/or cassette can be generally a quadrilateral, and in some embodiments, it is a parallelogram, a diamond, a rhombus, or a perfect rhombus (i.e., equal interior angles). The front edge can define a front side wall extending generally downward.

In yet further embodiments, the cassette has an inner wall, an outer wall, having a first outer wall segment and second outer wall segment, and a base wall generally extending between the inner wall and the outer wall to form a generally U-shaped liner cavity. A length of generally tubular liner film is at least partially contained within the liner cavity (prior to use and even during use, until the film is exhausted). In some embodiments, a lid at least partially containing the liner film within the liner cavity. The lid has a top exterior surface and a bottom interior surface opposite said top exterior surface, said lid.

The present disclosure is described herein in terms of aspects and embodiments of those aspects that include elements or features that may be included with the aspects. The identified embodiments may be included with the aspect of the invention singularly or in combination with any of the other identified embodiments as will be described herein below in the Detailed Description. The features and advantages of the present invention will become apparent in light of the detailed description of the invention provided below, and as illustrated in the accompanying drawings.

DETAILED DESCRIPTION

Figure 1:
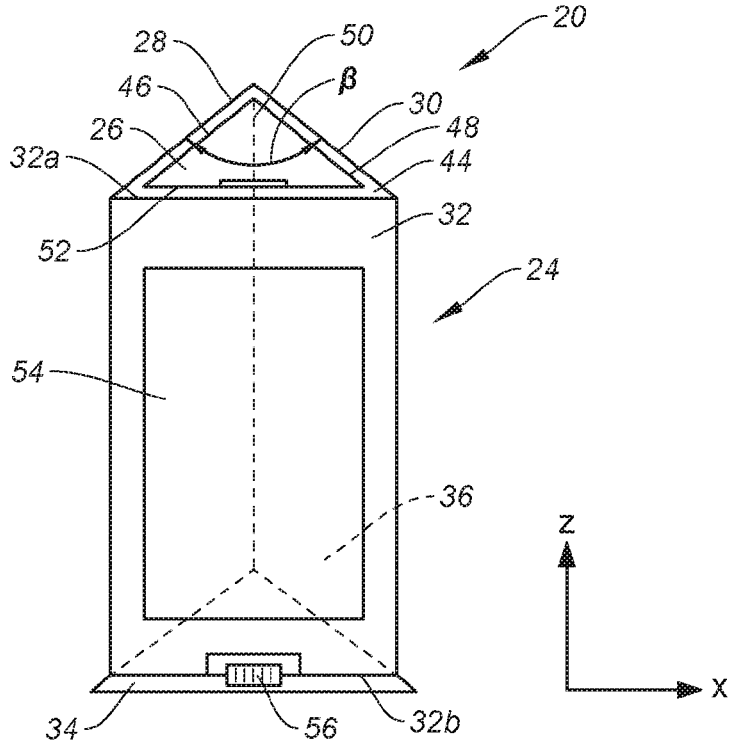
FIG. 1 is a diagrammatic perspective view of a waste disposal device embodiment.

Referring now to FIGS. 1-6, a compact waste disposal device 20 that includes a film-dispensing cassette 22 is provided. "Film cassette" and "cassette" are used interchangeably throughout the present disclosure. The waste disposal device 20 and the cassette 22 may be used for storing any type of waste items, but are well suited for the disposal of diapers, feminine hygiene articles, incontinence articles, absorbent pads, and pet waste.

The waste disposal device 20 includes a housing 24 and a lid 26. To facilitate the description herein, the waste disposal device 20 is described herein as having a width that extends along an X-axis, a depth that extends along a Y-axis, and a height that extends along a Z-axis; where X, Y, and Z are orthogonal axes (e.g., see FIGS. 1 and 8).

The housing 24 of the present compact waste disposal device 20 embodiments each have a first side panel 28, a second side panel 30, a front panel 32, and a base panel 34. The housing 24 is configured to facilitate placement of the unit in a corner of a room, with the front panel 32 generally facing toward the interior of the room and each side panel 28, 30 extending generally parallel to a respective room walls that forms the corner of the room (e.g., most room corners are right angle corners). In some embodiments, the housing 24 of the present compact waste disposal device 20 accommodates non-right angle corners caused by walls, molding, and another wall or object (i.e. a changing table, a crib, a chest or dresser, etc. . . . ). Housing 24 accommodates such non-right angle corners due to its shape an enables access to, for instance a shelf, a drawer, a wall outlet, switch, etc. . . . that causes a non-right angle corner. For example, if the housing 24 is placed in the corner of a square shaped room, the front panel 32 faces the center of the room, and each side panel 28, 30 extends generally parallel to a respective room wall that forms a portion of the room corner. The included angle "β" extending between the housing side panels 28, 30 is within the range of sixty to one-hundred and twenty degrees (60-120°). In further embodiments, β is within the range of about sixty degrees to one-hundred and five degrees (60-105°). In yet further embodiments, β is within the range of about seventy-five degrees to about ninety degrees (75-90°). The aforesaid housing 24 configuration provides a compact configuration that efficiently uses floor space within a room.

Figure 2:
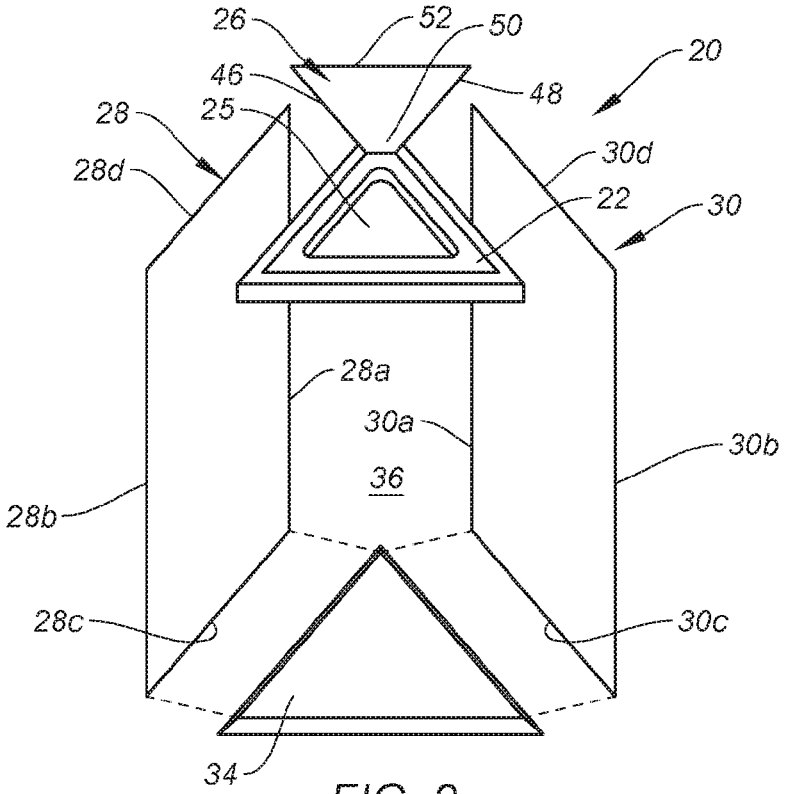
FIG. 2 is an exploded view of the waste disposal device shown in FIG. 1 with the lid disposed in the open position and the front panel omitted.

Now referring to FIG. 2, each side panel 28, 30 has a heightwise extending aft edge 28*a*, 30*a*, a heightwise extending forward edge 28*b*, 30*b*, a bottom edge 28*c*, 30*c*, and a top edge 28*d*, 30*d*. The bottom and top edges of each side panel 28, 30 extend between the forward and aft edges of the respective side panel. The front panel 32 has a top edge 32*a* and a bottom edge 32*b* (see FIG. 1). The front panel 32 extends between the side panels 28, 30, connecting to the respective forward edge of each side panel. The base panel 34 extends between and is connected to the side panels 28, 30 and the front panel 32, proximate the bottom edges of the respective panels. The side panels 28, 30, the base panel 34, and the front panel 32 collectively define an interior storage region 36.

Figure 5:
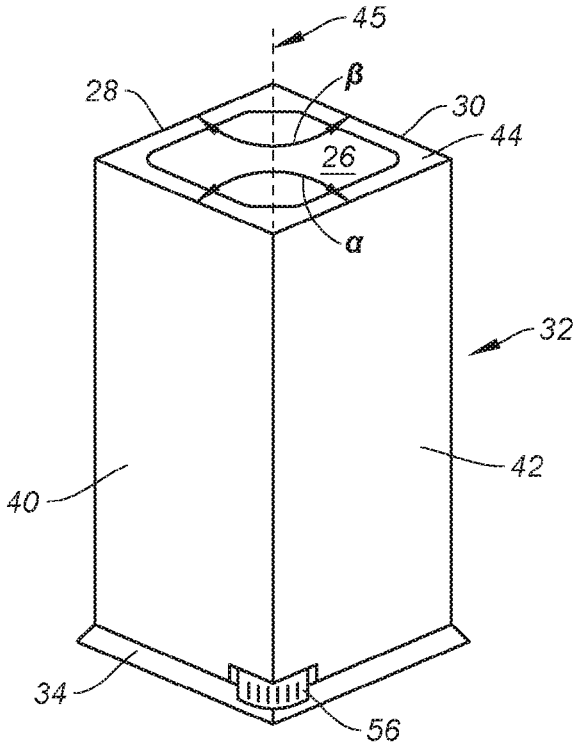
FIG. 5 is a diagrammatic perspective view of a waste disposal device embodiment.

In the embodiments shown in FIGS. 1 and 5, the side panels 28, 30 are connected to one another along their respective aft edges 28*a*, 30*a*. Hence, the side panels 28, 30 converge to create an aft corner of the housing 24. As indicated above, the included angle β extending between the side panels 28, 30 is within the range of sixty to one-hundred and twenty degrees (60-120°).

Figure 3:
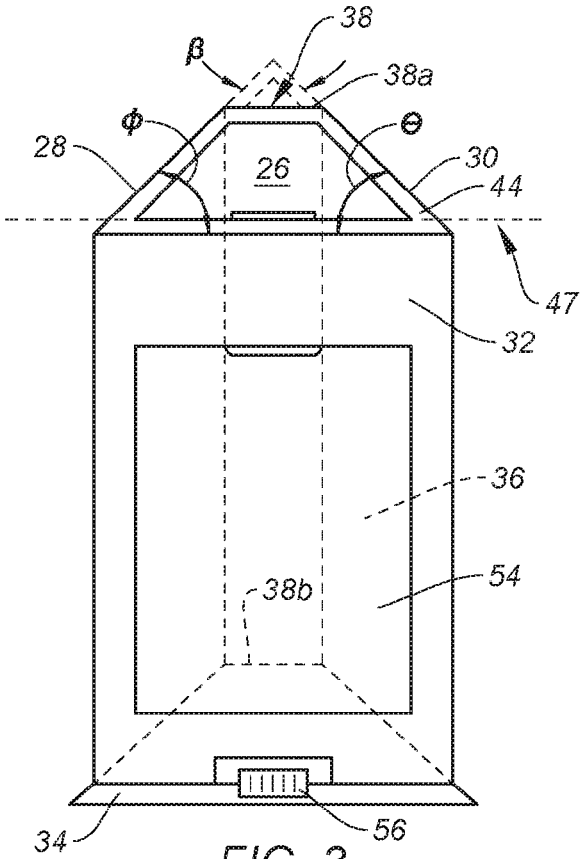
FIG. 3 is a diagrammatic perspective view of a waste disposal device embodiment.
Figure 4:
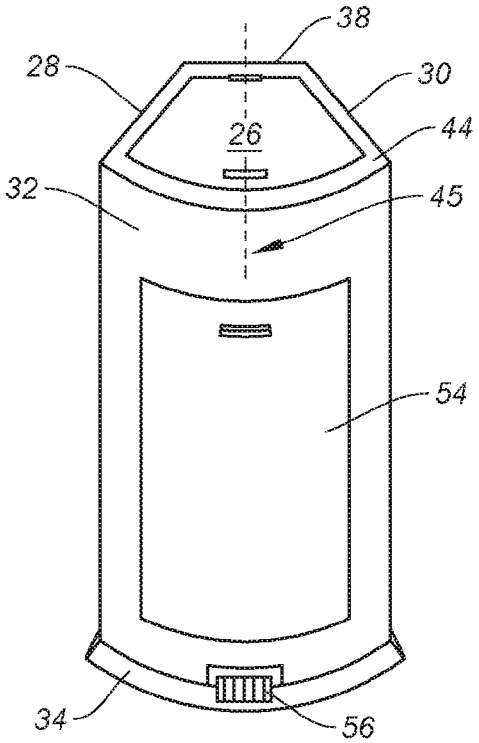
FIG. 4 is a diagrammatic perspective view of a waste disposal device embodiment.
Figure 6:
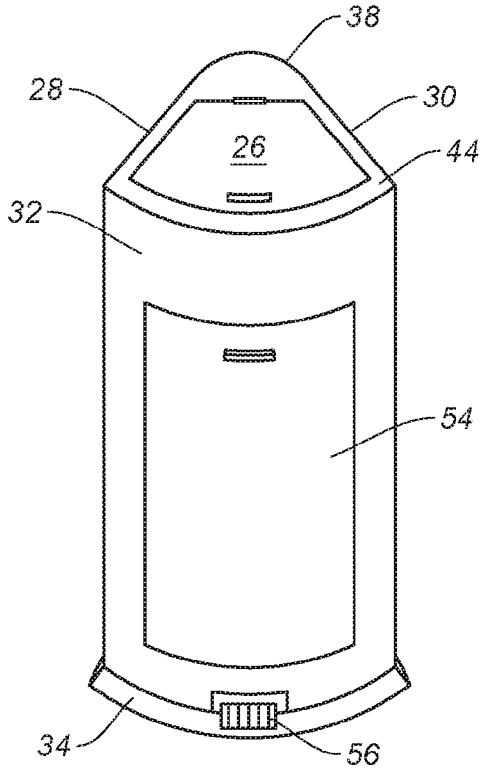
FIG. 6 is a diagrammatic perspective view of a waste disposal device embodiment.

In the embodiments shown in FIGS. 3, 4, and 6, the housing 24 includes an aft panel 38 having a top edge 38*a* and a bottom edge 38*b*. The aft panel 38 extends between the side panels 28, 30, connecting to the respective aft edge 28*a*, 28*b* of each side panel, and is also connected to the base panel 34. As indicated above, the included angle β extending between the side panels 28, 30 is within the range of sixty to one-hundred and twenty degrees (60-120°). The housing embodiment diagrammatically shown in FIGS. 3 and 4 illustrates a planar aft panel 38 extending between the side panels 28, 30. The housing 24 embodiment diagrammatically shown in FIG. 6 illustrates an arcuate aft panel 38 extending between the side panels 28, 30. Included angle φ extends between side panel 28 and front panel 32, while included angle θ extends between side panel 30 and front panel 32. In generally triangular embodiments (i.e. having three vertices), the included angles β, φ, and θ correspond to such vertices. Embodiments having four or more sides (i.e. having four or more included angles, such as but not limited to geometries similar to a frusto-conic slice) such that two vertices are generally aligned along an aft panel, the side panels 28, 30 can be projected to intersect and define included angle β.

The front panel 32 may assume a variety of different configurations. The housing 24 embodiments diagrammatically shown in FIGS. 1 and 3 illustrate a planar front panel 32 extending between the side panels 28, 30. The housing 24 embodiment shown in FIG. 1, may therefore, be described as generally triangular shaped. The housing 24 embodiment shown in FIG. 3, may therefore, be described as a generally trapezoidal shaped. The housing 24 embodiments diagrammatically shown in FIGS. 4 and 6 illustrate an arcuate front panel 32 extending between the side panels. The arcuate shape of the front panel 32 is not limited to any particular geometry; e.g., it may follow a single radius, a parti-oval shape, parti-circle shape, a multi-radii shape, conical, frusto-conical, etc. These embodiments may be referred to as having a two dimensional (2-D) cone shape.

In some embodiments, opening 25 can be enlarged by reflecting opening 25 (and/or the housing 24 and cassette 22) about axis 47 extending along front panel 32 to form a quadrilateral shape. Where it is an exact reflection, there is symmetry about an axis extending along front panel 32. In other embodiments, there may be symmetry running along axis 45. Axes 45, 47 can be defined with respect to panels or edges defining the waste disposal device 24, opening 25, the lid 26, the cassette 22 outer edge 69, the central passage 62, etc. . . . . It is further noted that any of the waste disposal device 24, opening 25, the lid 26, the cassette 22 outer edge 69, the central passage 62, etc. . . . can be similar or congruent shapes, or can be different shapes.

The housing 24 embodiment diagrammatically shown in FIG. 5 illustrates a front panel 32 having a first panel portion 40 and a second panel portion 42, which panel portions are each planar and are angularly disposed relative to one another with an included angle "α"; e.g., within the range of ninety to one hundred and fifty degrees (90-150°). The housing 24 embodiment shown in FIG. 5 may, therefore, be described as generally diamond-shaped. It is further noted, that included angles β and α (and likewise φ and θ) can be defined from edges or walls that form an outer edge or wall (i.e. β1 and/or α1), an inner edge or wall (i.e. β2 and/or α2), peripheral aspects of the lid (i.e. β3 and/or α3), and/or the opening (i.e. β4 and/or α4), such that there are included angles β1, β2, β3, and/or β4, where β1, β2, β3, and/or β4 can be equal, generally equal, and/or different. Similarly, included angle α can be defined such that there are included angles α1, α2, α3 and/or α4, where α1, α2, α3 and/or α4, can be equal, generally equal, and/or different. The same apply to included angles φ and θ. Other quadrilateral shapes including parallelograms, rectangles, rhomboids, perfect rhomboids, and kites (i.e. two pairs of equal length sides), are within the scope of the present disclosure.

The housing 24 may include a top panel 44 that engages the side panels 28, 30 and the front panel 32 (and aft panel 38 as applicable). As will be explained below, the top panel 44 may be configured to receive a film dispensing cassette 22 and configured to mate with a lid 26.

The components of the housing 24 (e.g., side panels 28, 30, front panel 32) may be independent components fastened together as indicated above, or two or more of the components may be fabricated as unitary structures; e.g., the side panels 28, 30 may be a unitary component and the front panel 32 attached, or the side panels 28, 30 and front panel 32 may be formed (e.g., by a molding process such as injection molding, blow molding, casting, rotomolding, thermoforming) as a unitary component. The present waste disposal device 20 is not limited to any particular process of manufacture or configuration.

The lid 26 of the present waste disposal device 20 is typically configured to generally complement the shape of the housing 24. The lid 26 generally covers waste disposal device 20 opening 25 which is sized to receive waste to be inserted and stored within housing 24. In some embodiments, the lid 26 includes side edges 46, 48 extending between an aft portion 50 and a forward edge 52 (e.g., see FIG. 2). The aft portion 50 is pivotally attached to the top panel 44 (or other housing element) to permit the forward edge 52 of the lid 26 to pivot toward and away from the housing 24; e.g., pivot to a closed position wherein the lid 26 is engaged with the housing 24 (e.g., the top panel) and thereby prevents access to the interior storage region 36, or pivot to an open position wherein the lid 26 is rotated away from opening 25 to provide access to the interior storage region 36. The lid 26 embodiments shown in FIGS. 1-6, for example, are generally planar with a configuration that reflects the geometry of the housing 24; e.g., substantially triangularly shaped with a straight or arcuate front edge, or have a trapezoidal shape, or have a diamond shape, etc.

The lid 26 may be connected to a side 28 or 30 of the waste disposal device 22 as opposed to at the aft portion 50, such that the waste disposal device 22 opens right-handed or left-handed. This is advantageous for waste disposal devices 22 that are likely to be situated in the corner of a room such that the lid 26 can freely swing upward from the top of the waste disposal device 22 (where the lid 26 is connected to the waste disposal device 22) a full ninety (90) degrees (and potentially greater than ninety (90) degrees, depending on the hinge location connecting the lid 26 to the waste disposal device, with respect to the wall (or any other object situated adjacent the waste disposal device 22). This is in contrast to lids hinged by the intersection of side panels 28, 30 which may have a reduced level of opening as the edges 46, 48, 52 and/or the top surface of the lid 26 may ultimately coincide with the walls of the room. In other embodiments where pails are a four sided polygon (i.e. having a shape similar to a frusto-conic section), the aft panel 38 increases the radius of the lid without attaching the lid 26 to one of side panels 28, 30. The lid 26 is not limited to any particular configuration.

The front panel 32 of the waste disposal device 20 may include a door 54 (e.g., see FIGS. 1, 3, 4, and 6) that can be opened to provide access to the interior storage region 36.

In some embodiments the lid 26 is connected to a foot pedal 56; e.g., disposed in the front panel 32. Depressing the foot pedal 56 operates a linkage (not shown) that causes the lid 26 to pivot open and thereby provide access to the inner storage region 36 of the waste disposal device 20. In some waste disposal devices 20, depressing the foot pedal 56 also causes a mechanism within the waste-disposal unit (e.g., a liner clamping assembly) to move to an "open position" where it permits deposit of waste within a liner below the opening 25. When the foot pedal 56 is released, the lid 26 closes automatically and the mechanism returns to its normally closed position. In the closed position, the mechanism clamps (or otherwise closes) the liner (e.g., to mitigate odor emanation).

Embodiments of the present waste disposal device 20 are configured to include a film cassette 22. The cassette 22 may be inserted and removed from the housing 24 vertically below the lid 26; e.g., the housing top panel 44 is configured to mount the film cassette 22 within the housing 24. The exemplary embodiment shown in FIGS. 1 and 2 has such a configuration. Other waste disposal devices 20 may be configured to permit insertion or removal of a film cassette 22 from the front panel 32 (or other panel) of the housing 24. Embodiments of the present film cassette 22 may be used in either of these configurations, and the present film cassette 22 is not limited to use in any particular waste disposal device 20.

Now referring to FIGS. 7-12, the present cassette 22 has a central passage 62. Central passage 62 has is defined by an inner wall edge 63 and in some embodiments, inner wall edge 63 defines an inner wall 64. In some embodiments, the cassette 22 has a liner cavity 58 that is outward of the central passage 62. The liner cavity 58 may assume a variety of configurations to hold the supply of liner film 60.

In some embodiments, the cassette 22 has an outer wall edge 69. In some embodiments, outer wall edge 69 defines an outer wall 68. In some embodiments, liner cavity 58 is located inward of outer wall 68 and is defined by outer wall 68. The liner cavity 58 may assume a variety of configurations to hold the supply of liner film 60.

In some embodiments, the cassette 22 has an outer wall 68 and an inner wall 64 defining liner cavity 58. Inner wall 64 further defines central passage 62.

Figure 7:
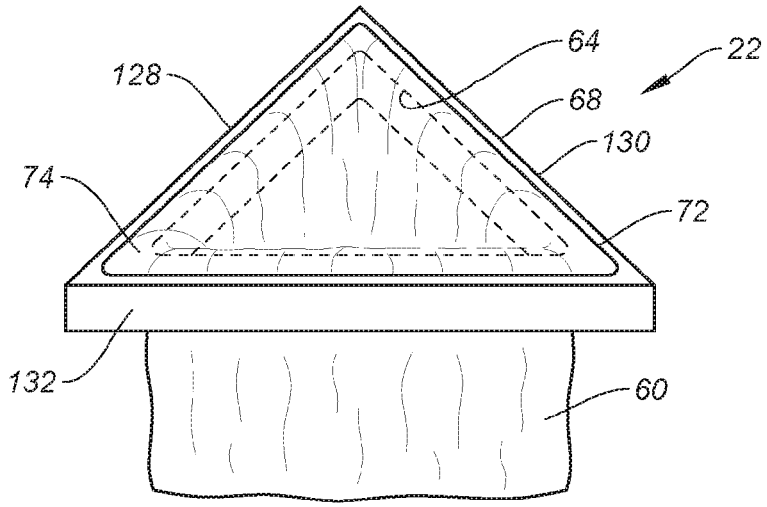
FIG. 7 is a diagrammatic perspective view of a film-dispensing cassette embodiment.
Figure 8:
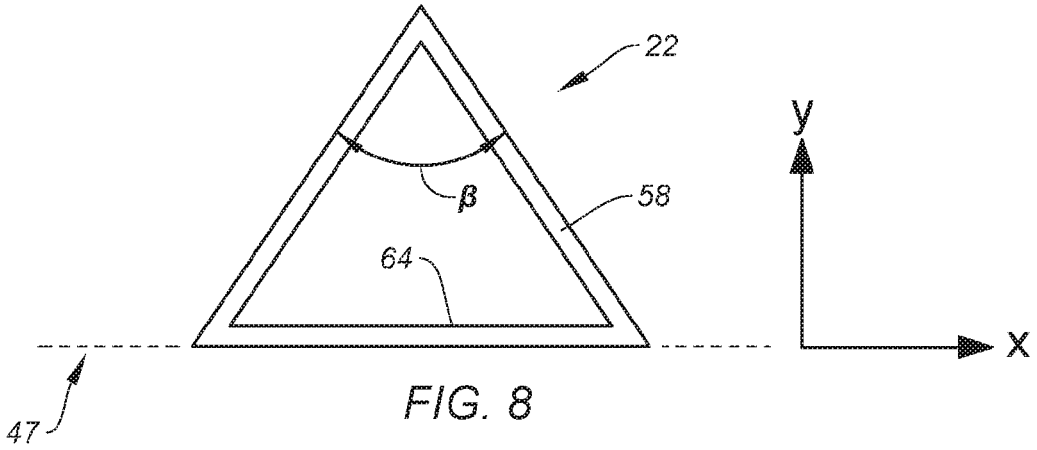
FIG. 8 is a diagrammatic top view of a film-dispensing cassette embodiment.
Figure 9:
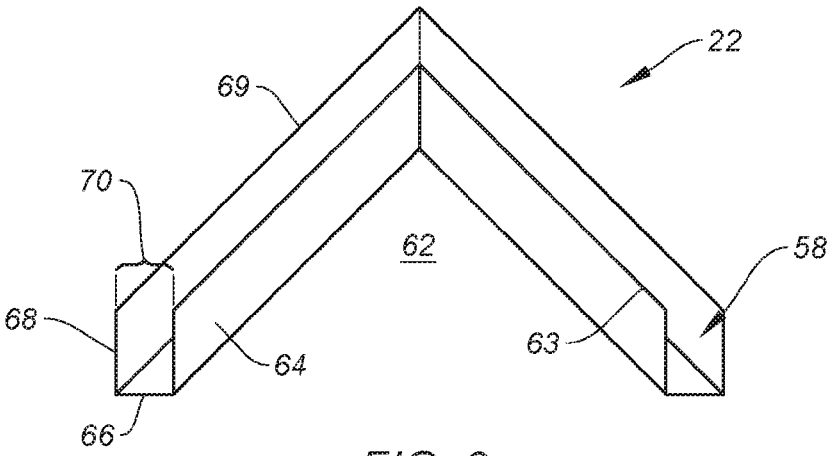
FIG. 9 is a sectional view of a film-dispensing cassette embodiment.
Figure 10:
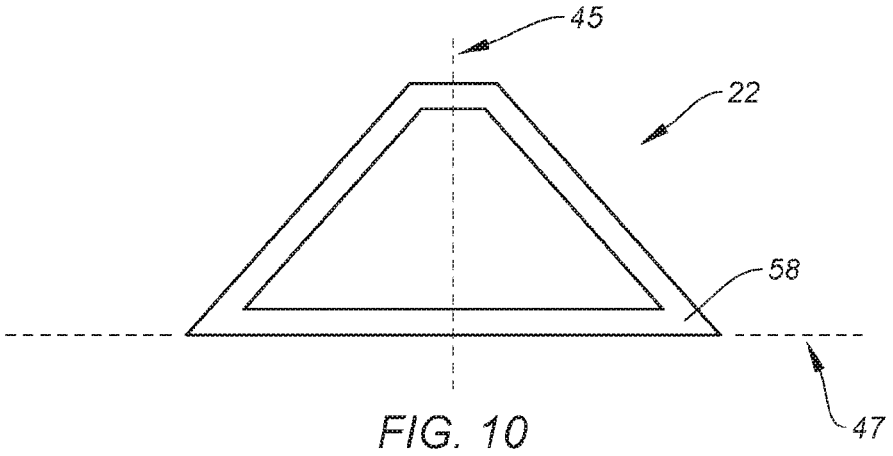
FIG. 10 is a diagrammatic top view of a film-dispensing cassette embodiment.

In the embodiment shown in FIGS. 7-9, the liner cavity 58 is defined by an inner wall 64, a bottom wall 66, and an outer wall 68. The inner wall 64 is radially inside of the outer wall 68 and the bottom wall 66 extends between and connects with the inner wall 64 and the outer wall 68; e.g., at or near bottom surface edges of the inner and outer walls 64, 68. Although the inner wall 64, bottom wall 66, and outer wall 68 are shown in FIG. 9 as having a solid wall structure, they are not limited to a solid wall configuration; e.g., one or more of the inner wall 64, bottom wall 66, and outer wall 68 may assume any configuration adequate to hold the supply of liner film 60. The liner cavity 58 may be formed as a continuous one piece structure (e.g., the inner and outer walls and bottom wall formed as a continuous one piece structure), or they may be multiple pieces connected together.

Alternatively, the cassette 22 has a length of liner 58 attachable to the cassette 22. In some embodiments, the liner 58 is attached to the cassette 22 such that the liner 58 extends into the central passage 62.

The inner wall 64, bottom wall 66, an outer wall 68 define a generally U-shaped cross-section having a liner cavity opening 70 that extends between a top surface edge 63 of the inner wall 64 and a top surface edge 69 of the outer wall 68. The cross-sectional shape of the liner cavity 58 may be consistent around the entire perimeter of the cassette 22 or it may vary in cross-sectional shape around the perimeter. In the embodiment shown in FIG. 9, the inner wall 64 is the interior cavity wall and defines the geometry of the central passage 62. In alternative embodiments, the inner wall 64 may be independent of the interior passage wall; i.e., the interior passage wall may be disposed radially inside of the inner wall 64 and is the structure that at least partially defines the central passage 62.

Figure 11:
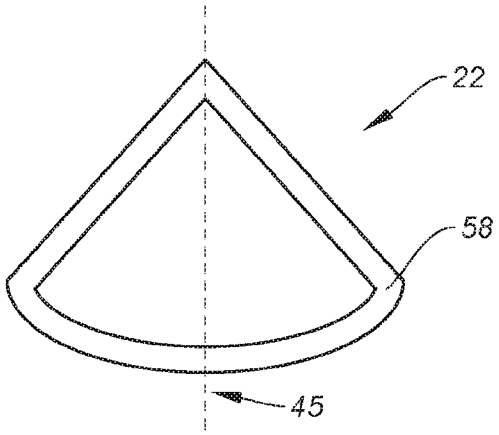
FIG. 11 is a diagrammatic top view of a film-dispensing cassette embodiment.
Figure 12:
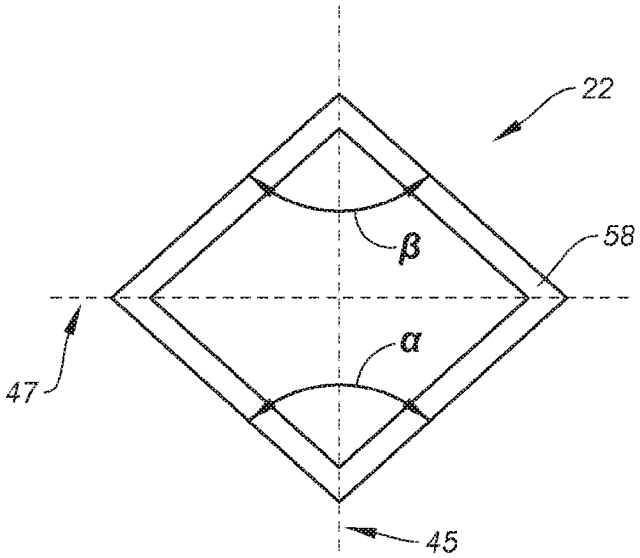
FIG. 12 is a diagrammatic top view of a film-dispensing cassette embodiment.

In most embodiments, the geometry of the cassette 22 (and its central passage 62) corresponds to the geometry of the waste disposal device 20. For example, in the embodiment shown in FIGS. 1 and 2, the waste disposal device 20 has a generally triangular shaped cross-sectional geometry (i.e., in the XY plane) with a planar front panel 32 as described above. In this embodiment as exemplified further by FIG. 7, the cassette 22 (and its central passage 62) also have a generally triangular shape and also has a front edge (or wall) 132 and side edges (or walls) 128, 130; e.g., see FIGS. 7-9. Alternatively, the waste disposal device 20 may have a generally trapezoidal shaped cassette 22. The trapezoidal shaped cassette 22 allows for a portion of the housing 24 (e.g., a portion of the top panel 44) aft of the cassette 22 to be used for the hinged attachment of the lid 26. The waste disposal device 20 shown in FIG. 3 has a generally trapezoidal shaped cross-sectional geometry as described above. In this embodiment, the cassette 22 (and its central passage 62) has a trapezoidal shape; e.g., see FIG. 10. The waste disposal device 20 embodiments shown in FIGS. 4 and 6 have a cone shaped cross-sectional geometry as described above. In this embodiment, the cassette 22 (and its central passage) also has a cone shape; e.g., a pointed cone cassette 22 as shown in FIG. 11 or a truncated cone. The waste disposal device 20 shown in FIG. 5 has a generally diamond shaped cross-sectional geometry as described above. In this embodiment, the cassette 22 (and its central passage) also have a generally diamond shape; e.g., see FIG. 12. In some embodiments, the maximum widthwise dimension is located proximal or on the front edge (or wall) 132. In embodiments having a quadrilateral shape, the maximum widthwise dimension extends along the bisector of $\theta$ and/or $\varphi$, or between such a bisector and the front edge (or wall) 132. In some embodiments, the maximum depthwise dimension is extends along the bisector of angle $\beta$. In embodiments having a quadrilateral shape, the maximum depthwise dimension extends along the bisector of angle $\beta$ and/or $\alpha$. In embodiments having a quadrilateral shape, the maximum depthwise dimension extends perpendicularly from the midpoint of axis 47 or along axis 45.

As indicated above, the side panels 28, 30 of the housing 24 are configured to have an included angle $\beta$ extending between the side panels 28, 30 in the range of sixty to one-hundred and twenty degrees (60-120°) to facilitate the space saving aspect of the present waste disposal device 20 embodiments. The geometry of the cassettes 22 typically mirror the aforesaid geometry to maximize the cross-sectional area of the central passage 62 of the cassette 22 (e.g., the cassette embodiment shown in FIG. 12 has included angles $\beta$ and $\alpha$). In some embodiments, edges and/or walls can have chamfers, roundels, or steeple shapes and/or be otherwise modified to reduce sharp edges and/or corners thusly assisting with manufacturability and/or reducing safety concerns. It is further noted, that included angles $\beta$ and a can be defined from edges or walls that form an outer edge or wall (i.e. $\beta 1$ and/or $\alpha 1$), an inner edge or wall (i.e. $\beta 2$ and/or $\alpha 2$), and/or the central passages (i.e. $\beta 3$ and/or $\alpha 3$), such that there are included angles $\beta 1$, $\beta 2$ and/or $\beta 3$, where $\beta 1$, $\beta 2$ and/or $\beta 3$ can be equal, generally equal, and/or different. Similarly, included angle $\alpha$ can be defined such that there are included angles $\alpha 1$, $\alpha 2$ and/or $\alpha 3$, where $\alpha 1$, $\alpha 2$ and/or $\alpha 3$ can be equal, generally equal, and/or different.

In other embodiments, the cassette 22 outer edge 69 (or outer wall 68) defines a shape that is different than the central passage 62. For instance the outer edge 69 (or outer wall 68) may have a generally triangular shaped cross-sectional geometry while the central passage 62 has an arcuate cross-sectional geometry. In some embodiments, each edge or wall may have multiple panels, segments or facets (straight, arcuate or undulating) and may duly form a generally polygonal shape. Other shapes for either geometry are within the scope of the disclosure (i.e. square, squircle, rectangular, hexagonal, octagonal, decagonal, dodecagonal, etc. . . . ). Embodiments where the outer geometry defined by the outer edge 69 (or outer wall 68) is different from the geometry of the central passage 62 can be advantageous for providing liner film 60 and additional benefits such as odor-controlling strips, pouches, sachets, etc. . . . located in such excess space between the outer geometry and central passage 62 (e.g., the outer geometry is a conic and the inner geometry is a frusto-conic).

In other embodiments, the cassette 22 outer cross-sectional geometry defined by the outer edge 69 (or outer wall 68) differs from the geometry of the waste disposal device 20 to enable further waste disposal device 20 mechanics (i.e. the lid 26 engagement or other cassette 22/waste disposal device 20 engagement features) or enable additional benefits such as odor-controlling strips, pouches, sachets, etc. . . . to be placed onto or into the waste disposal device 20 (as opposed to incorporating into the cassette 22). For instance, the waste disposal device 20 may have a cross-sectional geometry of a rhombus, a diamond a kite, etc . . . , while the cassette 22 outer edge 69 (or outer wall 68) is triangular. Similarly, the geometry of the waste disposal device 20 can vary from the geometry of the central passage 62 as described throughout the present disclosure.

The liner film 60 is a film formed in a closed perimeter configuration that extends a length. The closed perimeter configuration is such that the liner 60 material has a continuous perimeter that extends lengthwise; e.g., the configuration may be described as "tubular". The cross-sectional configuration of the liner film 60 (i.e., the cross-sectional perimeter shape) may vary depending on the particular configuration. The liner film 60 is comprised of a material that is flexible, capable of being stored within the liner cavity 58, capable of being readily drawn out of the liner cavity 58, and capable of being formed in a closed configuration (e.g., knotted) as will be described below. A flexible plastic film is an example of an acceptable liner film 60. The liner film can include one or more layers of polyethylene, polypropylene, polyester, EVA, EVOH, nylon, tie resin, and may further include additives such as carbon, calcium carbonate, talc, titanium dioxide, and slip agents. Embodiments of the liner film 60 may include agents that mask odor such as fragrance, mitigate odors including odor adsorbers and odor absorbers, etc.

As indicated above, the liner cavity 58 defines a cavity sized to hold the supply of liner film 60. The liner film 60 is stored within the liner cavity 58 in an orientation that allows incremental portions of the liner 60 to be drawn out of the liner cavity 58. In the embodiment shown in FIG. 7, the cassette 22 is configured such that the liner film 60 may be drawn out of the liner cavity 58 through an opening 72 disposed at the liner cavity opening 70; e.g., the cassette 22 diagrammatically shown in FIG. 7 includes a cover panel 74 that substantially covers the liner cavity opening 70, creating the opening 72 through which the liner film 60 is drawn out of the liner cavity 58. The present cassette 22 is not limited to any particular liner path configuration, e.g., liner film 60 may alternatively be drawn out of the liner cavity 58 through the bottom wall 66, the inner wall, or the outer wall 68 of the liner cavity 58. In embodiments where liner film 60 is drawn out of the outer wall or inner wall, it may be done so through an end proximal the lid or the bottom wall. The present cassette 22 is also not limited to any particular manner for arranging the liner film 60 within the liner cavity 58 (e.g., folded, pleated, etc.), provided the liner film can be readily drawn out from the liner cavity 58 on demand by the user.

The present cassette 22 can be removed and replaced from the waste disposal device 20 as needed. For example, in the waste disposal device embodiment shown in FIGS. 1, 3, 4, and 6, the cassette 22 can be replaced by accessing the pail, by, for example, opening the lid 26, removing the empty cassette 22 from the housing 24 (if necessary), and placing an unused cassette 22 into the housing 24. The user then withdraws a length of the liner film 60 from the liner cavity 58, feeds it through the central passage 62, and into the inner storage region 36, so that the free end of the liner film 60 is disposed near the lower end of the device 20. The user then closes off the free end of the liner film 60 to form a liner film "bag" (e.g., by tying the liner film into a knot adjacent the free end) and closes the device 20. In this configuration, the waste disposal device 20 (and specifically the liner film 60) is ready to receive waste such as, but not limited to, disposable diapers, nappies, training pants, feminine hygiene products, incontinence products, pet waste and pet waste receiving articles. Gravitational forces urge whatever waste is deposited into the liner film bag toward the closed-off free end of the liner film bag. When the liner film bag is full of waste, the upper end of the liner film 60 may be separated from the supply of liner film (e.g. by cutting the liner film 60 at a point above the stored waste), and the bag is removed from the waste disposal device 20. The just-separated end of the liner film 60 may then be closed (e.g., by knot or fastener) and the bag disposed of. The process is then repeated; e.g., the user withdraws another length of the liner film 60 from the liner cavity 58, drawing it through the central passage 62 and into the interior storage region 36. The user then closes off the free end of the liner material to form a new liner film bag.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed herein as the best mode contemplated for carrying out this invention.

The invention claimed is:

1. A film cassette for receiving waste, comprising:

an outer wall edge defining an outer perimeter in a first XY plane;

an inner wall edge defining a central passage and an inner perimeter in the first XY plane, comprising:

an inner first side edge;

an inner second side edge, wherein the inner first side edge and the inner second side edge have an inner included angle therebetween in the first XY plane in the range of about 60 degrees to about 120 degrees;

an inner front edge, extending between and connected to the inner first side edge and the inner second side edge; and a length of flexible liner film having, during use, an open end for receiving waste and a closed end for storing waste within the liner film;

wherein the inner wall edge of the film cassette has a shape that is generally triangular, a Reuleaux triangle, a conical section, a frusto-conical section, or combinations thereof, wherein the shape is with respect to the inner perimeter, and wherein the open end of the liner film is attached to the film cassette within the outer perimeter and the inner perimeter such that the liner film extends downwardly from the film cassette to the closed end, and wherein the liner film passes downwardly through the central passage in order to store waste within the liner film.

2. The film cassette according to claim 1, wherein the inner included angle is between about 60 degrees and about 105 degrees.

3. The film cassette according to claim 2, wherein the inner included angle is between about 75 degrees and about 90 degrees.

4. The film cassette according to claim 1, wherein outer wall edge is defined by an outer first side edge, and outer second side edge, and an outer front side edge, wherein the outer first side edge and the outer second side edge from an outer included angle of between about 60 degrees and about 120 degrees.

5. The film cassette according to claim 1, wherein the outer wall edge is a shape that is different from the central passage as defined by the inner wall edge.

6. The film cassette according to claim 1, wherein the cassette has a maximum widthwise dimension located proximal the inner front edge, and wherein the cassette has a maximum depthwise dimension extending along a bisector of the inner included angle.

7. A cassette for receiving waste, comprising:

a first side edge;

a second side edge, wherein the first side edge and the second side edge have a first included angle therebetween in the range of about 60 degrees to about 120 degrees;

a front edge having a first edge portion and a second edge portion such that said first edge portion and said second edge portion have a second included angle therebetween in the range of about 90 to about 150 degrees; and a length of flexible liner film having, during use, an open end for receiving waste and a closed end for storing waste, wherein said cassette is diamond in shape.

8. The cassette of claim 7, wherein said first side edge, said second side edge and said front edge define a central passage through which said liner film passes in order to store waste.

9. The cassette of claim 8, wherein said first side edge defines a first side wall extending generally downward, said second side edge defines a second side wall extending generally downward, and said front edge defines a front wall extending generally downward, wherein said first side wall, said second side wall, and said front wall further define said central passage.

10. The cassette of claim 7, wherein said first side edge, said second side edge and said front edge define an outer edge.

11. The cassette of claim 10, wherein said first side edge defines a first side wall extending generally downward, said second side edge defines a second side wall extending generally downward, and said front edge defines a front wall extending generally downward, wherein said first side wall, said second side wall, and said front wall further define an outer wall.

12. A film cassette for receiving waste, comprising:

an outer wall edge defining an outer perimeter in a first XY plane;

an inner wall edge defining a central passage and an inner perimeter in the first XY plane, comprising:

an inner first side edge;

an inner second side edge, wherein the inner first side edge and the inner second side edge have an included angle therebetween in the first XY plane in the range of about 60 degrees to about 120 degrees;

an inner front edge, extending between and connected to the inner first side edge and the inner second side edge; and a length of flexible liner film having, during use, an open end for receiving waste and a closed end for storing waste within the liner film;

wherein the cassette has a maximum widthwise dimension located proximal the inner front edge, and wherein the cassette has a maximum depthwise dimension extending along a bisector of the inner included angle, and wherein the open end of the liner film is attached to the film within the outer perimeter and the inner perimeter such that the liner film extends downwardly from the film cassette to the closed end, and wherein the liner film passes downward through the central passage in order to store waste within the liner film.

13. The cassette according to claim 12, wherein at least one of said first side edge, said second side edge, and said front edge is arcuate.

14. The film cassette according to claim 12, wherein the inner front edge further comprises an inner first front edge segment and an inner second front edge segment.

15. The film cassette according to claim 14, wherein the inner first front edge segment has an inner first end and an inner second end, and the inner second front edge segment has an inner third end and an inner fourth end, the inner first end of the inner first front edge segment connectable to the inner first side edge, and the inner fourth end of the inner second front edge segment connectable to the inner second side edge.

16. The film cassette according to claim 15, wherein the inner second end of the inner first front edge segment connects to the inner third end of the inner second front edge segment and forms a second included angle between about 60 degrees and about 150 degrees.

17. The film cassette according to claim 16, wherein the inner first side edge and the inner first end of the inner first front edge segment form a third included angle, and the inner second side edge and the inner fourth end of the inner second front edge segment form a fourth included angle.

18. The film cassette according to claim 17, wherein the maximum widthwise dimension is between a bisector of the third included angle and the inner front edge such that the maximum widthwise dimension is proximal the inner front edge.

19. The film cassette according to claim 17, wherein the maximum widthwise dimension is between a bisector of the fourth included angle and the front edge such that the maximum widthwise dimension is proximal the inner front edge.

20. A film cassette for receiving waste, comprising:

an outer wall edge defining an outer perimeter in a first XY plane, comprising:

an outer first side edge;

an outer second side edge, wherein the outer first side edge and the outer second side edge have an outer included angle therebetween in the first XY plane in the range of about 60 degrees to about 120 degrees;

an outer front edge, extending between and connected to the outer first side edge and the outer second side edge; and an inner wall edge defining a central passage and an inner perimeter in the first XY plane;

a length of flexible liner film having, during use, an open end for receiving waste and a closed end for storing waste within the liner film;

wherein the outer wall edge of the film cassette has a shape that is generally triangular, a Reuleaux triangle, a conical section, a frusto-conical section, or combinations thereof, wherein the shape is with respect to the outer wall edge, and wherein the open end of the liner film is attached to the film cassette within the outer perimeter and the inner perimeter such that the liner film extends downwardly from the film cassette to the closed end, and wherein the liner film passes downwardly through the central passage in order to store waste within the liner film.

21. The film cassette according to claim 20, wherein the outer included angle is between about 60 degrees and about 105 degrees.

22. The film cassette according to claim 21, wherein the outer included angle is between about 75 degrees and about 90 degrees.

23. The film cassette according to claim 20, wherein inner wall edge is defined by an inner first side edge, and inner second side edge, and an inner front side edge, wherein the inner first side edge and the inner second side edge from an inner included angle of between about 60 degrees and about 120 degrees.

24. The film cassette according to claim 20, wherein the inner wall edge is a shape that is different from the central passage as defined by the inner wall edge.

25. The film cassette according to claim 20, wherein the cassette has a maximum widthwise dimension located proximal the outer front edge, and wherein the cassette has a maximum depthwise dimension extending along a bisector of the outer included angle.

26. A film cassette for receiving waste, comprising:

an outer wall edge;

an inner wall edge defining a central passage, comprising:

an inner first side edge;

an inner second side edge, wherein the inner first side edge and the inner second side edge have an inner included angle therebetween in the first XY plane in the range of about 60 degrees to about 120 degrees;

an inner front edge, extending between and connected to the inner first side edge and the inner second side edge, and a liner cavity defined between the outer wall edge and the inner wall edge, the liner cavity having a cavity opening; and a length of flexible liner film being stored in the liner cavity prior to use, the liner film having, during use, an open end for receiving waste and a closed end for storing waste within the liner film;

wherein the inner wall edge of the film cassette has a shape that is generally triangular, a Reuleaux triangle, a conical section, a frusto-conical section, or combinations thereof, wherein the shape is with respect to the outer wall edge, and wherein during use, the liner film is drawn out through the cavity opening and extends downwardly from the film cassette through the central passage in order to store waste within the liner film.

27. The film cassette for receiving waste of claim 26, wherein the inner first side edge defines an inner first side wall extending downward, the inner second side edge defines an inner second side wall extending downward, and the inner front edge defines an inner front wall extending downward, wherein the inner first side wall, the inner second side wall, and the inner front wall further define the inner wall and the central passage, and wherein the outer first side edge defines an outer first side wall extending downward, the outer second side edge defines an outer second side wall extending downward, and the outer front edge defines an outer front wall extending downward, wherein the outer first side wall, the outer second side wall, and outer inner front wall further define the outer wall.

28. The film cassette according to claim 27, further comprising a bottom wall that connects to the outer wall and the inner wall at an inner wall bottom surface edge and an outer wall bottom surface edge, wherein the liner cavity is defined by the outer wall, the inner wall, and the bottom wall, wherein the inner wall bottom surface edge is in a second XY plane that is below the first XY plane.

29. The film cassette according to claim 28, wherein the cross-sectional shape of the liner cavity varies.

30. The film cassette according to claim 26, wherein the inner included angle is between about 60 degrees and about 105 degrees.

31. The film cassette according to claim 30, wherein the inner included angle is between about 75 degrees and about 90 degrees.

32. The film cassette according to claim 26, wherein outer wall edge is defined by an outer first side edge, and outer second side edge, and an outer front side edge, wherein the outer first side edge and the outer second side edge from an outer included angle of between about 60 degrees and about 120 degrees.

33. The film cassette according to claim 26, wherein the outer wall edge is a shape that is different from the central passage as defined by the inner wall edge.

34. The film cassette according to claim 26, wherein the cassette has a maximum widthwise dimension located proximal the inner front edge, and wherein the cassette has a maximum depthwise dimension extending along a bisector of the inner included angle.

35. A film cassette for receiving waste, comprising:

an outer wall edge defining an outer perimeter in a first XY plane, comprising:

an outer first side edge;

an outer second side edge, wherein the outer first side edge and the outer second side edge have an outer included angle therebetween in the first XY plane in the range of about 60 degrees to about 120 degrees;

an outer front edge, extending between and connected to the outer first side edge and the outer second side edge; and an inner wall edge defining a central passage;

a liner cavity defined between the outer wall edge and the inner wall edge, the liner cavity having a cavity opening; and a length of flexible liner film being stored in the liner cavity prior to use, the liner film having, during use, an open end for receiving waste and a closed end for storing waste within the liner film;

wherein the outer wall edge of the film cassette has a shape that is generally triangular, a Reuleaux triangle, a conical section, a frusto-conical section, or combinations thereof, wherein the shape is with respect to the outer perimeter, and wherein during use, the liner film is drawn out through the cavity opening and extends downwardly from the film cassette through the central passage in order to store waste within the liner film.

36. The film cassette according to claim 35, wherein the outer included angle is between about 60 degrees and about 105 degrees.

37. The film cassette according to claim 36, wherein the outer included angle is between about 75 degrees and about 90 degrees.

38. The film cassette according to claim 36, wherein inner wall edge is defined by an inner first side edge, and inner second side edge, and an inner front side edge, wherein the inner first side edge and the inner second side edge from an inner included angle of between about 60 degrees and about 120 degrees.

39. The film cassette according to claim 36, wherein the inner wall edge is a shape that is different from the central passage as defined by the inner wall edge.

40. The film cassette according to claim 36, wherein the cassette has a maximum widthwise dimension located proximal the outer front edge, and wherein the cassette has a maximum depthwise dimension extending along a bisector of the outer included angle.

41. The film cassette for receiving waste of claim 35, wherein the inner first side edge defines an inner first side wall extending downward, the inner second side edge defines an inner second side wall extending downward, and the inner front edge defines an inner front wall extending downward, wherein the inner first side wall, the inner second side wall, and the inner front wall further define the inner wall and the central passage, and wherein the outer first side edge defines an outer first side wall extending downward, the outer second side edge defines an outer second side wall extending downward, and the outer front edge defines an outer front wall extending downward, wherein the outer first side wall, the outer second side wall, and outer inner front wall further define the outer wall.

42. The film cassette according to claim 41, further comprising a bottom wall that connects to the outer wall and the inner wall at an inner wall bottom surface edge and an outer wall bottom surface edge, wherein the liner cavity is defined by the outer wall, the inner wall, and the bottom wall, wherein the outer wall bottom surface edge is in a second XY plane that is below the first XY plane.

43. The film cassette according to claim 42, wherein the cross-sectional shape of the liner cavity varies.

* * * * *